United States Patent [19]

Bosque

[11] Patent Number: 4,592,256

[45] Date of Patent: Jun. 3, 1986

[54] COMBINATION RATCHET AND SPINNER WRENCH

[76] Inventor: Raul A. Bosque, 9029 Scott St., Bellflower, Calif. 90706

[21] Appl. No.: 693,056

[22] Filed: Jan. 22, 1985

[51] Int. Cl.[4] ..... B25B 17/00

[52] U.S. Cl. ..... 81/57.29; 81/57.13

[58] Field of Search ..... 81/57.29, 57.13

[56] References Cited

U.S. PATENT DOCUMENTS

| | | | |
|---|---|---|---|
| 2,900,856 | 8/1959 | Maier | 81/57.13 |
| 3,733,936 | 5/1973 | Flynn | 81/57.29 |
| 4,086,829 | 5/1978 | Hudgins | 81/57.29 |
| 4,528,873 | 7/1985 | Lee | 81/57.29 |
| 4,532,832 | 8/1985 | Christensen | 81/57.29 |

FOREIGN PATENT DOCUMENTS

| | | | |
|---|---|---|---|
| 625352 | 4/1927 | France | 81/57.29 |

*Primary Examiner*—Frederick R. Schmidt
*Assistant Examiner*—J. T. Zatarga
*Attorney, Agent, or Firm*—Albert O. Cota

[57] ABSTRACT

A combination ratchet and spinner wrench having a normal ratcheting capability and a free-spinning mode that can be used to easily and quickly pre-tighten a nut or bolt prior to final tightening or to remove a nut or bolt after it is initially loosened by the ratchet portion. This feature does not require the handle to be oscillated and is particularly useful when devices are located in areas where finger manipulation is difficult or impossible. Free-spinning is achieved by a combination of elements that include a rotatable housing incorporating a three-position pawl that has a neutral position as well as the two standard ratchet positions, a secondary bevel gear and a spinner drive shaft having at opposite ends a primary bevel gear and a spin knob. When the pawl is placed in neutral it is disengaged from the annular ratchet gear thus allowing the drive shaft to be directly rotated by the spin knob. As the shaft turns the primary bevel gear turns the secondary bevel gear that transmits the rotational power directly to the socket shank.

16 Claims, 9 Drawing Figures

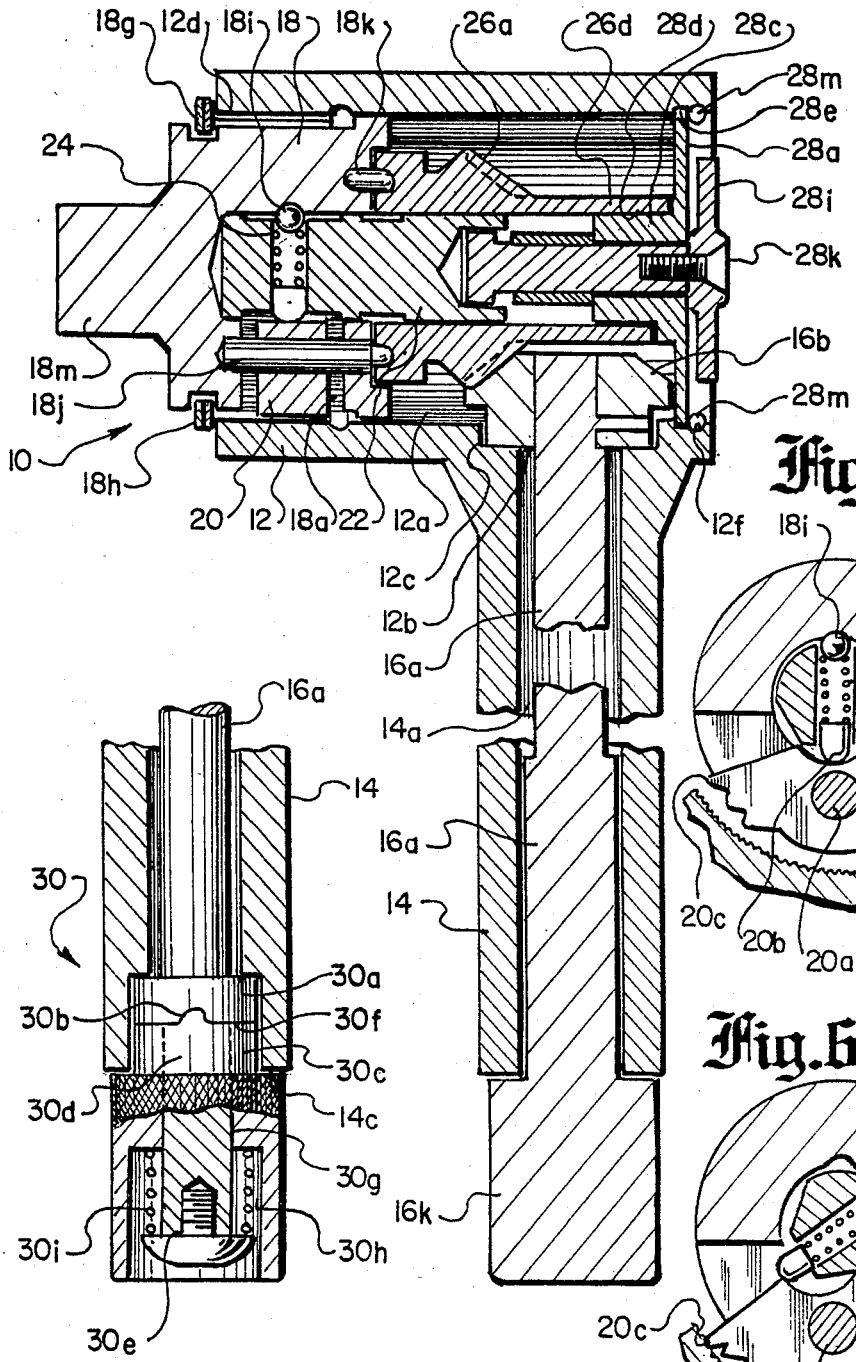
Fig.5.
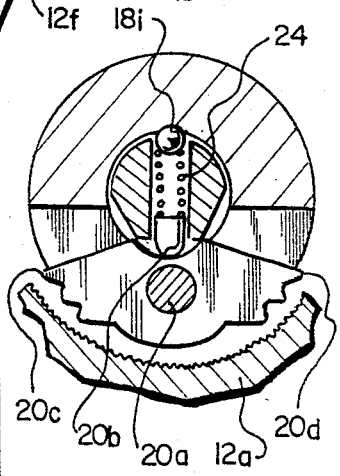
Fig.6.
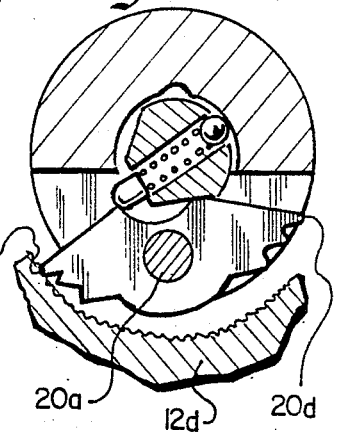
Fig.9.
Fig.4

COMBINATION RATCHET AND SPINNER WRENCH

TECHNICAL FIELD

The invention pertains to the general field of ratchet wrenches and more particularly to a wrench having conventional ratcheting capability as well as a free-spinning mode.

BACKGROUND ART

Ratchet wrenches having a mechanism for changing the direction of torque have been well known in the art for many years. Additionally, combination wrenches employing conventional ratcheting capability as well as a rotary movement of the socket shank that is independent of an oscillation of the handle have also been disclosed. The rotary movement, or as also referred to as a free-spinning mode, is used to either pre-tighten a nut or bolt until it becomes finger tight or to remove a nut or bolt after it has been broken loose by the ratchet section of the wrench.

Many of the patents disclosing wrenches with independent rotary motion describe complex mechanical designs requiring that a plurality of rotary drive elements, including the ratchet gear, be operated to produce the required free-spinning mode. Because of this mechanical complexity, the rotary drive may cause the wrench to bind or it may disengage under load from the drive mechanism causing a work stoppage and/or require a wrench repair. Additionally, the wrench wear-out rate is higher and it is more expensive to manufacture and maintain.

In some of these designs, it is also necessary that the handle rotate during a ratcheting operation. This condition makes it difficult to maintain a tight grip on the handle or if it is tightly gripped, an injury to the palm of the hand may result due to the abrasive action of the rotating handle. Additionally, the back pressure exerted on the two mating bevel gears, when the handle is firmly held during a ratcheting operation, causes accelerated wear on the gears.

A search of the prior art did not disclose any patents that read directly on the claims of the instant invention. However, the following U.S. patents are considered related and indicative of the state-of-the-art:

| U.S. PAT. NO. | INVENTOR | ISSUED |
|---|---|---|
| 4,448,095 | Blodgett, R. | 15 May 1984 |
| 4,318,314 | Furedi, E., et al | 9 March 1982 |
| 4,277,989 | Tracy, K. | 14 July 1981 |
| 4,128,025 | Main, H. | 5 December 1978 |
| 4,086,829 | Hudgins, J. | 2 May 1978 |
| 3,733,936 | Flynn, W. | 22 May 1973 |

The Blodgett patent discloses a ratchet wrench having a ratcheting mechanism that may be reversed by turning the handle of the wrench. The initial twist of the handle causes the driving elements ot ratchet in one direction. Continued turning of the handle, beyond the initial position, results in placing the wrench in the opposite ratcheting direction. The mechanism disclosed also allows the handle to remain stationery (not rotate) during a ratcheting stroke.

The Furedi patent discloses a ratchet wrench assembly that is used to unthread or thread a loosened nut or bolt from a threaded shaft. The wrench is comprised of a barrel assembly that includes a clutching mechanism that is connected to the drive shaft. Thus, rotation of the barrel assembly causes the drive shaft to rotate which, in turn, causes the drive stud to subsequently rotate in a responsive rotational direction.

The Tracy patent discloses a reversible ratchet wrench handle in which the actuator for the direction reversing mechanism is located close to the handle that is grasped by the user. This location permits the user to operate the actuator with the thumb of the hand holding the handle. Thus, changing the direction of operation of the wrench is a one handed rather than a two handed operation.

The Main patent discloses a ratchet wrench incorporating a ratcheting mechanism that includes a rotatable and extendable shaft housed within the wrench handle, a set of shaft mounted bevel gears, a circular bevel gear that drives the drive stud and a ratchet pawl switch.

When it is desired to use the wrench in the ratchet mode the shaft is fully inserted into the handle. In this position, one of the shaft bevel gears engages the gear on the ratched pawl allowing the wrench to ratchet in one direction. To ratchet in the opposite direction the shaft is rotated. When it is desired to operate the wrench in a non-ratchet mode to continue loosening a nut or bolt, the shaft is fully withdrawn from the handle. In this position, the bevel gear engaging the pawl is disconnected and instead the other shaft bevel gear directly engages the circular bevel gear.

The Hudgins patent discloses a ratchet wrench having a rotational hand-grip speed-handle located around the wrench handle. A drive means is included within the handle that connects the hand-grip to the ratchet means located in the wrench head. The rotation of a nut or bolt is achieved by rotating the speed-handle about its own axis. This feature may be used for final tightening or after the nut or bolt has been broken loose and is being unthreaded for removal. Thus, the wrench may be used in a conventional manner for exerting maximum torque force or used in a screw-driver fashion when only minimum force is required.

The Flynn patent discloses a wrench having both a ratchet drive and a high speed gear drive that is connected to and activated by a rotational hand-grip. To apply a nut to a stud, the nut is initially placed in the socket attached to the shank. The hand-grip is then rotated which transmits the rotational movement of the hand-grip to the nut via a shaft, gears and the socket shank. When the nut is relatively tight, the force of hand hand-grip is released and the wrench handle is oscillated back and forth to effect a normal ratchet operation. To remove a nut, the above steps are reversed, the ratchet being used to loosen the nut until it turns freely and then the hand-grip is rotated to finish removing the nut.

For background purposes and as indicative of the art to which the invention relates, references may be made to U.S. patent numbers:

| U.S. PAT. NO. | INVENTOR | ISSUED |
|---|---|---|
| 4,311,072 | Hudgins, J. | 19 January 1982 |
| 4,137,801 | Imperio, C. | 6 February 1979 |
| 3,707,893 | Hofman, B. | 2 January 1973 |

DISCLOSURE OF THE INVENTION

The spinner ratchet wrench in addition to having a normal ratcheting mode also includes a free-spinning mode that is achieved without having the pawl engage the ratchet gear. When the wrench is in the ratcheting mode the design of the wrench allows the handle to remain in one radial position; that is, the handle will not rotate radially, as do some of the prior art designs, when the handle is oscillated back-and-forth.

The free-spinning mode is used to easily and quickly pre-tighten a nut or bolt prior to final tightening or to remove a nut or bolt after it has been broken loose. This feature is particularly useful when a nut or bolt is located in an area where removal of the nut or bolt by the finger would be difficult if not impossible. The free-spinning mode is achieved by a combination of parts that includes a three-position pawl that has a neutral position as well as the normal loosening and tightening positions and a spinner shaft.

The spinner shaft has on its front end a primary bevel gear that drives a secondary bevel gear attached to the socket shank and an integral spin knob on its opposite end that is used to manually rotate the shaft. The shaft and primary bevel gear are housed within the wrench handle and head housing with the spin knob extending behind the handle.

To place the wrench into the free-spinning mode the three-position pawl is placed in the neutral position by means of an easily accessible lever. When in neutral, the pawl is disengaged from the ratchet gear which allows the spinner shaft to rotate freely and subsequently directly rotate the socket shank in response to the rotation of the spin knob. Note that the spinning mode does not require the wrench handle to be oscillated back and forth which is important when the area being worked does not have sufficient lateral clearance to easily allow the wrench handle to be 1 moved.

The primary object of the invention is to provide a free-spinning mode that can be easily and quickly set and that is accomplished by a direct power transfer from the primary bevel gear on the spinner shaft to the secondary bevel gear driving the socket shank. At no time during the free-spinning mode is the pawl or ratchet gear operative. In addition to this primary object it is also an object to provide a wrench that:

is not cumbersome to use and that feels "good" to the user, incorporates a three-position pawl that is easily and positively set in the selected work position, allows the wrench handle to remain in a stationery radial position (not rotate) when the handle is oscillated during a ratcheting operation, incorporates a simple free-spinning drive that will not bind or be disengaged under load, will help prevent burns to the hands when working on hot parts such as those found in confined areas of an automobile engine, can be adapted to use commercially available sockets, and is cost effective to manufacture and that is reliable and easy to maintain the event of a malfunction.

These and other objects and advantages of the present invention will become apparent from the subsequent detailed description of the preferred embodiment and the claims taken in conjunction with the accompanying drawings.

BRIEF DESCRIPTION OF THE DRAWINGS

FIG. 4 is a cut-away side view of the preferred embodiment of the wrench taken along lines 4—4 of FIG. 3.

FIG. 5 is a front sectional view showing the three-position pawl set in the neutral position.

FIG. 6 is a front sectional view showing the three-position pawl in one of its engagement positions with the annular ratchet gear.

FIG. 9 is a cut-away view showing the clutch assembly in the engaged position.

BEST MODE FOR CARRYING OUT THE INVENTION

Figure 1:
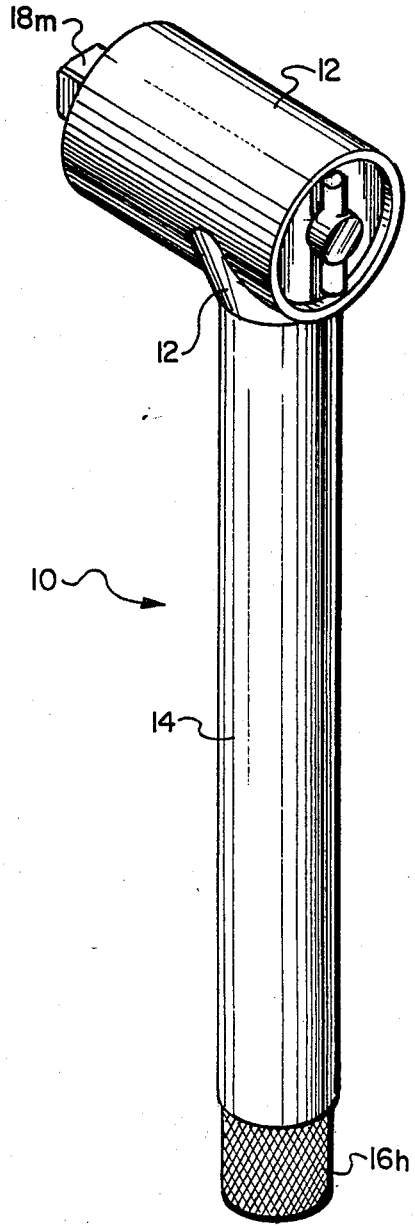
FIG. 1 is a perspective view of the improved spinner ratchet wrench.
Figure 2:
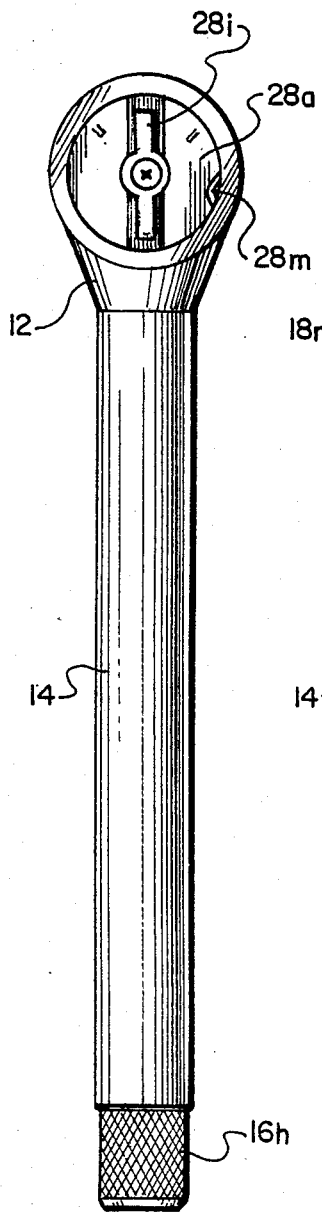
FIG. 2 is a back plan view of the wrench.
Figure 3:
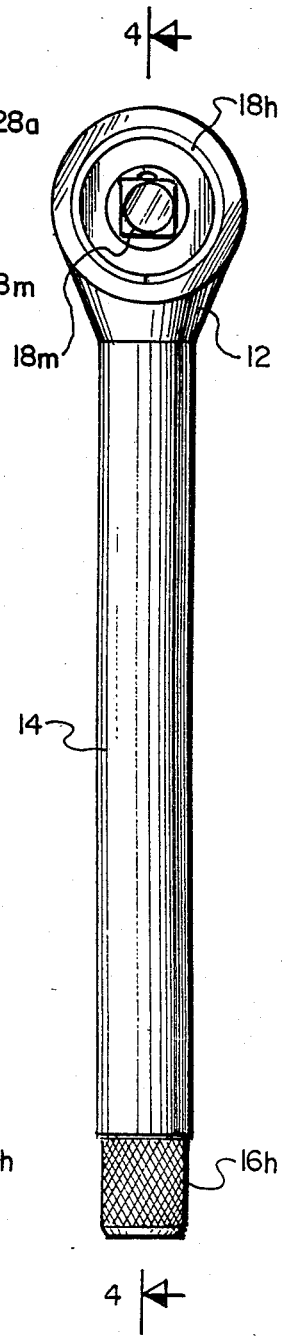
FIG. 3 is a front plan view of the wrench.

The best mode for carrying out the invention of the improved combination ratchet and spinner wrench 10 is presented in terms of a preferred embodiment and a second embodiment that modifies the preferred design by the addition of a clutch assembly 30. The wrench 10 in the preferred embodiment, as shown in FIGS. 1 through 8, is comprised of the following six major elements: a front housing 12, a handle 14; a spinner drive shaft assembly 16; and a ratchet/spinner assembly 17.

Figure 8:
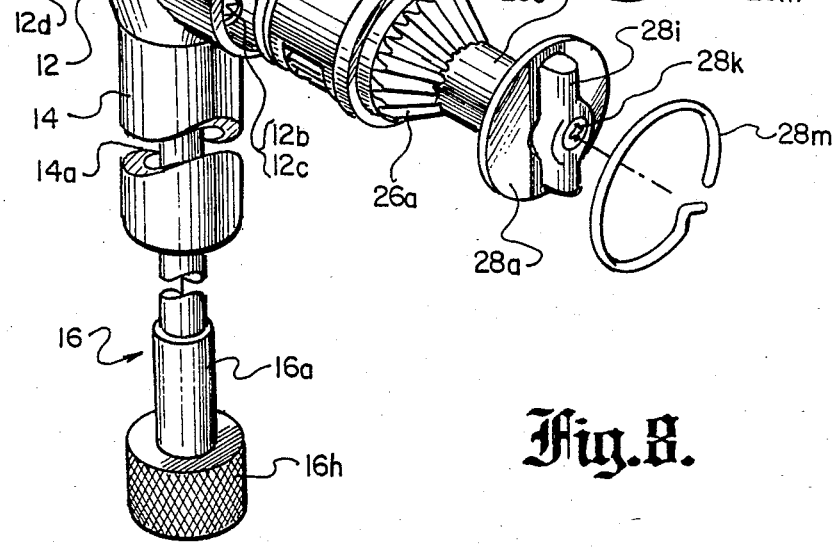
FIG. 8 is an impacted exploded view of the overall wrench in the preferred embodiment.

The front housing 12, as best shown in FIGS. 4 and 8, houses the driving and rotational mechanism referred to as the ratchet/spinner assembly 17. In the preferred embodiment the housing is a cylindrical structure having a longitudinal housing bore 12*a* extending therethrough. On the bottom side of the housing, as shown in FIG. 4, is located a drive shaft bore 12*a* that is drilled normal to the longitudinal housing bore 12*a*. Inside the housing bore, superimposed over the drive shaft bore 12*b*, is a primary bevel gear cavity 12*c* that has a diameter slightly larger than the primary bevel gear 16*b* described infra.

On the front internal circumference of the housing is located a fixed annular ratchet gear 12*d* that is attached by conventional methods well known in the art. On the back internal circumference is located a housing cover cavity 12*e* and superimposed over the cavity is a housing cover retainer channel 12*f*. The housing and the other members of the wrench are constructed, in the preferred embodiment, of a tool quality steel.

The handle 14, as best shown in FIGS. 1 and 4, is sized both in length and diameter to provide the user with a comfortable and leveraged grip. The handle has a spinner shaft bore 14*a* therethrough that is aligned with the drive shaft bore 12*b* on the front housing. In the preferred embodiment the handle 14 and front housing 12 are an integral piece. However, the handle may be a separate piece that is attached to the housing in a conventional manner.

Figure 7:
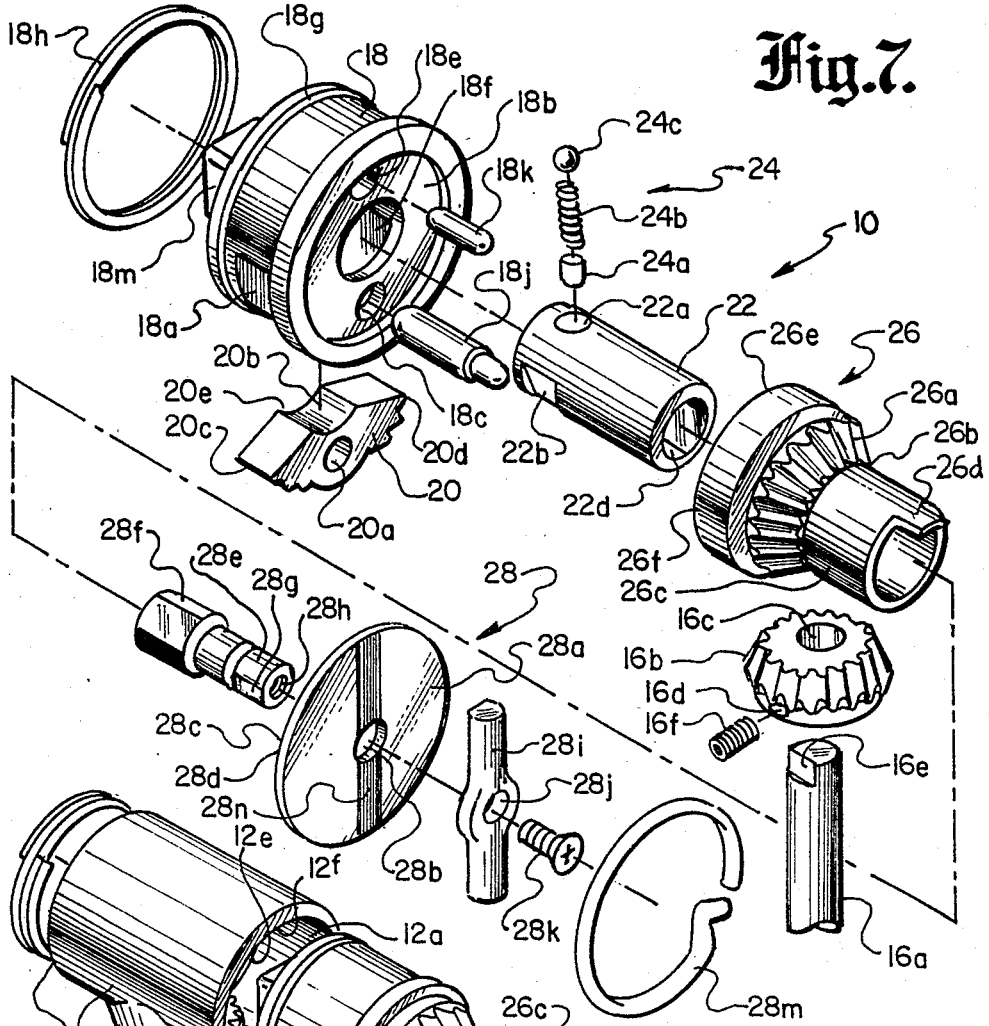
FIG. 7 is a partial exploded view of the overall wrench in the preferred embodiment.

The spinner drive shaft assembly 16, as shown in FIGS. 4, 7 and 8, is comprised of a spinner drive shaft 16*a* having a diameter that allows the shaft to rotatably fit into the drive shaft bore 12*b* on the front housing and spinner shaft bore 14*a* on the handle. On the top end of the shaft, that is the end inserted through the drive shaft bore 12*b*, is located a primary bevel gear 16*d*. When the gear 16b is attached, it is rotatably set within the primary bevel gear cavity 12c on the front housing. The primary bevel gear 16b, in the preferred embodiment, is attached by employing a bevel gear that has a shaft keyed bore 16c and a radially oriented threaded bore 16d therethrough as shown in FIG. 7. The keyed bore 16c is designed to fit over and rest on a spinner drive shaft keyed end 16e. To secure the gear, a set screw 16f is threaded into the threaded bore 16d and tightened.

On the bottom end of the spinner drive shaft 16a, as shown in FIGS. 1–4, is a spin knob 16h that is knurled and is an integral part of the shaft 16a. The shaft has a length to allow the spin knob to be narrowly spaced behind the handle 14 as best shown in FIG. 4. In the preferred embodiment the knob has a diameter that is less than the diameter of the handle 14. However, a spin knob with a diameter equal to the handle may also be used. By having a smaller diameter, there is less chance that the rotation of the spin knob will be felt by the hand when the handle is oscillated during a ratcheting operation.

The shaft next to the spin knob and for a short length upwardly has a diameter that is larger than the upper part of the shaft and slightly less than the diameter of the spinner shaft bore 14a as shown in FIG. 4. By having this dual diameter configuration the shaft remains concentric within the bore 14a when the spin knob is rotated during operation of the spin mode.

The ratchet/spinner assembly 17, as shown in FIGS. 4 and 7, is housed within the front housing and is comprised of the following six elements: a rotatable housing subassembly 18; a three-position pawl 20; a pawl indexing and connecting shaft 22; a pawl detent hold subassembly 24; a secondary bevel gear subassembly 26; and a housing cover and pawl position selector subassembly 28.

The rotatable housing subassembly 18 is a cylindrical structure that has on its front end an integral socket shank that in the preferred embodiment accepts standard ⅜ inch (0.953 cm) sockets. However, any size socket shank is adaptable for use on the wrench. On the lower side of the subassembly is a pawl mounting channel 18a that is sized to pivotally accept the three-position pawl 20.

The back wall of the subassembly, as best shown in FIG. 4, includes a pawl indexing shaft cavity 18f that extends through the back wall and that is open to the pawl mounting channel 18a. The rotatable housing also has a pawl pivot pin cavity 18c on the front wall of the channel, a pawl pivot pin bore 18d through its back surface that is aligned with the pivot pin cavity 18c and a secondary bevel gear restraining pin cavity 18e that is also located on its back surface above the pawl indexing shaft cavity 18f and in vertical alignment with the pawl pivot pin bore 18d.

The rotatable housing subassembly 18 is rotatably restrained within the longitudinal housing bore 12a by a housing retaining clip 18h that is snapped into a housing retaining clip channel 18g located on the front of the housing. The rotatable housing is best shown in place within the front housing in FIG. 4.

The three-position pawl 20, which is one of the most important of the inventive elements, allows the wrench to have a conventional ratcheting mode as well as a free-spinning mode. The pawl 20, as best shown in FIG. 7, is constructed of a single structure and is sized to pivotally fit within the pawl mounting channel 18a. The three-positions of the pawl consist of an ON detent position 20c on one end, an OFF detent position 20d on the other end and a centrally located NEUTRAL detent position 20b. The two pawl ends 20c, 20d are designed to selectively engage the annular ratchet gear 12d, while the NEUTRAL position allows the pawl to be selectively disengaged from the annular ratchet gear. When the pawl is engaged, the wrench operates as a conventional ratchet wrench. When the pawl is placed in the NEUTRAL position the spin knob 16h may be rotated to allow rotational power to be directly transmitted to the socket shank 18m.

The pawl 20 is pivotally held within the pawl mounting channel 18a by a pawl pivot pin and secondary bevel gear restraining pin 18j. The pin 18j is inserted in turn, through the pawl pivot pin bore 18d, through a pawl pivot bore 20a that is centrally located through the side of the pawl, and into the pawl pivot pin cavity 18c.

The pawl indexing and connecting shaft 22, as best shown in FIG. 7, interconnects the rotatable housing subassembly 18 with the secondary bevel gear subassembly 26, provides a pawl indexing means and serves as a housing for the pawl detent hold subassembly 24.

The front of the shaft is sized to rotatably fit into the pawl indexing shaft cavity 18f on the rotatable housing 18. The configuration of the shaft 22 includes a pawl detent bore 22a as shown in FIG. 7, that is drilled through the front section of the shaft centrally aligned with respect to the width of the pawl 20. The shaft also has an ON detent flat 22b and an OFF detent flat 22c that are angularly displaced on each lower side of the detent bore as best shown in FIGS. 5 and 6.

The back of the shaft has a keyed shift lever cavity 22d that accepts the front keyed section of the shift lever shaft 28e described infra.

The pawl indexing and connecting shaft 22 when rotated allows the pawl 20 to be set in either of its three positions. To radially maintain and hold the shaft in the selected position, a pawl detent hold subassembly 24 is employed. This subassembly is comprised of three parts that are inserted into the pawl detent bore 22a in the following order: a detent pin 24a, a detent compression spring 24b, and a detent ball 24c. When the shaft 22, together with the subassembly 24, are inserted into the pawl indexing shaft cavity 18f, the detent pin 24a makes contact with the pawl detent surface 20e on the pawl 20, and the detent ball 24c makes contact with the concave ball detent 18i on the rotatable housing. Thus, the subassembly 24 provides the required pressure to maintain the pawl in the selected position.

The secondary bevel gear subassembly 26 provides the direct drive to the socket shank 18m. The secondary bevel gear 26a, as best shown in FIGS. 4 and 7, is sized and positioned within the longitudinal housing bore 12a in the front housing to mesh with the primary bevel gear 16b in a 90-degree miter fashion. The gear has an indexing shaft bore 26b therethrough into which is inserted and rigidly held by conventional means a hollow indexing shaft 26c that only extends from the front of the gear, that is the end that points towards the back of the front housing 12. The shaft 26c includes a key tab 26d that fits into a key slot 28d located on the housing cover and pawl position selector subassembly 28 described infra and the shaft also has an internal diameter that allows the shaft 26c to fit over the back end of the pawl indexing and connector shaft 22.

The back of the secondary bevel gear subassembly 26, that is the end pointing towards the back side of the rotatable housing subassembly 18 has a first gear restraining cavity 26e and a second gear restraining cavity 26f in vertical alignment above and below the indexing shaft bore 26b.

The first cavity 26e is also aligned with the secondary bevel gear restraining pin cavity 18e while the second cavity 26f is aligned with the pawl pivot pin cavity 18c and the secondary bevel gear restraining pin 18j.

To set the secondary bevel gear 26a into the secondary bevel gear mounting cavity on the rotatable housing 18, a secondary bevel gear restraining pin 18k in inserted into the cavity 18e and the bevel gear 26 is slipped into the shaft 22 and over the two pins 18k, 18j.

The final element comprising the ratchet/spinner assembly 17 is the housing cover and pawl position selector subassembly 26. The subassembly is comprised of three elements the housing cover 28a, a shift lever shaft 28e and a shifting bar 28i.

The cover, as shown in FIG. 4, is sized in both thickness and diameter to fit into the front housing cover cavity 12e and be retained in that position by a housing cover retaining clip 28m that is inserted into the housing cover retainer channel 12f.

The cover 28a has a centrally located shift lever shaft bore 28b and a shift lever shaft sleeve 28c conventionally attached to the back of the cover over the bore 28b. The sleeve has a key slot 28d that is sized to accept the key tab 26d on the hollow indexing shaft 26c. Through the sleeve 28c and bore 28b is inserted the shift lever shaft 28e. This shaft has a front keyed section 28f and a back keyed section 28g that also includes a threaded bore 28h. The front key 28f is keyed to fit into the keyed shift lever cavity 22d on the pawl indexing and connecting shaft 22.

The back keyed section 28g is sized to accept a keyed shifting bar bore 28j located on the shifting bar 28i. The shifting bar is held in place by threading a shifting bar retaining screw 28k into the threaded bore 28h. The top of the cover also includes a vertical pawl indexing reference mark 28n. When the shifting bar 28i is aligned with the mark it indicated that the wrench is in the spin mode, conversely when the bar is offset from the mark it indicates that the wrench is in one of the ratcheting mode.

The preferred embodiment of wrench 10 as previously described may be modified by the inclusion of the clutch assembly 30 which allows a combination back clutch plate/spin knob 30c to be manually rotated until a nut or bolt becomes finger tight at which point the clutch will slip and will rotate without imparting any further torque to the nut or bolt. When this slippage occurs, it is an indication to the user that the ratchet section of the wrench should be used to complete the tightening by moving the shifting bar 28i to the ON detent position.

There are several clutch mechanisms and configurations that may be employed. The typical clutch assembly 30 described requires changes to the preferred embodiment handle 14, the spinner drive shaft 16a, and the spin knob 16h.

The handle 14 in this embodiment requires that a clutch plate cavity 14c be included at the lower end of the handle as shown in FIG. 9.

The spinner drive shaft 16a has a similar front configuration as previously described. However, the back section includes a larger diameter disk that serves as the forward clutch plate 30a. The backside of the forward clutch plate has a concave detent 30b near the clutch's plate perimeter as shown in FIG. 9. Integrally extending from the backside of the forward clutch plate 30a is a centrally located clutch shaft 30d that has at its end a retaining bolt threaded bore 30e.

The combination back clutch plate spin knob 30c, in the preferred embodiment, has on its front side a convex detent 30f located and sized to fit into the concave detent 30b located on the forward clutch plate 30a. The back clutch plate also includes a clutch shaft bore 30g having a diameter slightly greater than that of the clutch shaft 30d; and a clutch spring cavity 30h extending from its backside.

The back clutch plate spin knob 30c is compressively held against the forward clutch plate 30a by a clutch spring 30i that is inserted over the clutch shaft 30d and within the clutch spring cavity 30h. The spring 30i is held in compression by the shaft/clutch retaining bolt 30j that is threaded into the threaded bore 30e located on the clutch shaft 30d.

When the clutch is in the engaged position, as shown in FIG. 9, and the three-position pawl 20 is placed in the NEUTRAL position, the back clutch plate spin knob 30c may be rotated to apply a direct power transfer from the knob to the nut or bolt being tightened. Conversely, when the rotational torque exceeds the clutch's holding torque, the clutch will disengage and the back clutch plate spin knob will continue to rotate pass the detents 30b, 30f without imparting any torque to the socket shank 18.

OPERATION

The combination ratchet and spinner wrench 10 can be used as either a conventional two position ratchet wrench or as a wrench having a manually controlled free-spinning shank drive. To use the wrench 10 in the free-spinning mode all that is required is to set the shifting bar 28i in the center NEUTRAL position. In this position, the three-position pawl 20 is disengaged from the annular ratchet gear 12d which allows the spinner drive shaft 16a to be freely rotated by manually rotating the spin knob 16h. This inventive feature allows the wrench user to quickly pre-tighten a nut or bolt prior to final torqueing or to quickly loosen and remove the nut or bolt after it is initially loosened. The free-spinning mode is particularly useful when such nuts or bolts are located in areas where finger manipulation may be difficult or impossible.

While the invention has been described in complete detail and pictorially shown in the accompanying drawings, it is not to be limited to such details, since many changes and modifications may be made to the invention without departing from the spirit and the scope thereof. Hence, it is described to cover any and all modifications and forms which may come within the language and scope of the claims.

I claim:

1. An improved combination ratchet and spinner wrench comprising:

(a) a front housing having a longitudinal housing bore extending therethrough, a drive shaft bore located normal to the longitudinal housing bore and a fixed internal circumference annular ratchet gear on the inside front end of said housing, (b) a handle having a spinner shaft bore therethrough that is aligned with the drive shaft bore on said front housing and where front end of said handle is rigidly attached to said front housing, (c) a spinner drive shaft assembly having on its top end a rigidly attached primary bevel gear and on its bottom end a spin knob where when said shaft is inserted into the drive shaft bore on said handle the primary bevel gear is located within said front housing and the spin knob extends beyond the bottom end of said handle, (d) a ratchet/spinner assembly positioned within the longitudinal housing bore on said front housing where said assembly comprises:

A. a rotatable housing subassembly further comprising:

(1) an integral socket shank that extends beyond front of said subassembly and beyond the end of said front housing, (2) a three-position pawl having an ON detent position on one end, an OFF detent position on the other end and a center NEUTRAL position, where the two pawl ends are designed to selectively engage the annular ratchet gear on said front housing in two of its three positions where its center is a neutral position allowing said pawl to be selectively disengaged from the internal ratchet gear, B. means to selectively place said three-position pawl in either of its three positions, C. a secondary bevel gear subassembly positioned within the longitudinal housing bore on said front housing and designed to mesh with the primary bevel gear on said spinner drive shaft, and, D. a pawl indexing and connecting shaft that connects said rotatable housing subassembly with said secondary bevel gear subassembly.

2. An improved combination ratchet and spinner wrench comprising:

(a) a front housing having:

A. a longitudinal housing bore extending therethrough,

B. a drive shaft bore located on the bottom side of said housing normal to the longitudinal housing bore C. a primary bevel gear cavity superimposed over the drive shaft bore, D. a housing cover cavity and housing cover retainer channel on back end of said housing, E. a fixed internal-circumference annular ratchet gear on the inside front end of said housing, (b) a handle having a spinner shaft bore therethrough that is aligned with the drive shaft bore on said front housing and where front end of said handle is rigidly attached to said front housing, (c) a spinner drive shaft assembly comprising a spinner drive shaft sized to rotatably fit into the spinner shaft bore on said handle and into the drive shaft bore on said front housing with said drive shaft having on its top end a rigidly attached primary bevel gear cavity on said front housing and on its bottom end is located a spin knob where said drive shaft has a length that allows the spin knob to be narrowly spaced behind the bottom end of said handle, (d) a ratchet/spinner assembly positioned within the longitudinal housing bore on said front housing where said assembly comprises:

A. a rotatable housing subassembly having:

(1) an integral socket shank on its front end, (2) a pawl mounting channel on its lower side, (3) a concave ball detent located on the upper wall of the pawl indexing shaft cavity that is aligned equidistant from the ends of the pawl mounting channel, (4) secondary bevel gear mounting cavity on its back side, (5) a pawl indexing shaft cavity extending centrally through the back side and open to the pawl mounting channel, (6) a secondary bevel gear retaining means located on the secondary bevel gear mounting cavity, (7) means to rotatably restrain said subassembly within the longitudinal housing bore of said front housing, B. a three-position pawl having an ON detent position on one end, an OFF detent position on the other end and a center NEUTRAL position, where the two pawl ends are designed to selectively engage the annular ratchet gear on said front housing and where center neutral position allows said pawl to be selectively disengaged from the internal ratchet gear, C. a means to pivotably hold said pawl within the pawl mounting channel on said subassembly, D. a pawl indexing and connecting shaft where front end of said shaft is sized to rotatably fit into the pawl indexing shaft cavity on said rotatable housing subassembly and with back end of said shaft having a keyed shift lever cavity, E. a means to radially maintain and hold said pawl indexing and connecting shaft when rotated to either of its selected pawl indexing positions, F. a secondary bevel gear subassembly comprising a secondary bevel gear sized to mesh in a 90-degree miter fashion with the primary bevel gear on said spinner drive shaft subassembly, with said secondary bevel gear having an indexing shaft bore into which is inserted and rigidly held a hollow indexing shaft having a key tab and where the indexing shaft diameter is sized to rotatably fit into the back end of said pawl indexing and connecting shaft, G. a housing cover and pawl position selector subassembly comprising:

(1) a housing cover sized to fit into and having means to be retained within the housing cover cavity on said front housing with said cover having a centrally located shift lever shaft bore, (2) a shift lever shaft sleeve rigidly attached to the back side of said housing cover over the shift lever shaft bore with the sleeve having a key slot that accepts the key tab on the hollow indexing shaft on the secondary bevel gear subassembly, (3) a shift lever shaft sized to rotatably fit through the shift lever shaft sleeve and bore on said cover and having on its front and back ends a keyed section where front keyed section fits into the keyed shaft lever cavity on said pawl indexing and connecting shaft, and (4) a keyed shifting bar having means to be rigidly attached to the back keyed section of said shift lever shaft.

3. The wrench as specified in claim 1 further comprising a housing cover sized to fit and cover the back end of said front housing with said cover having a shift lever shaft bore into which is inserted a shift lever shaft which is mechanically connected to the three-position pawl and provides the means by which the pawl is selectively placed in either of its three positions.

4. The wrench as specified in claim 2 wherein said front housing and said handle are an integral piece.

5. The wrench as specified in claim 2 wherein said primary bevel gear is rigidly attached to the top end of said spinner drive shaft by employing a bevel gear having a shaft keyed bore and a radially oriented threaded bore therethrough into which is threaded a set screw that makes contact with the surface of a keyed end on said spinner drive shaft.

6. The wrench as specified in claim 2 wherein the means to retain said secondary bevel gear to the back side of said rotatable housing where said housing has said pawl in place is accomplished by having:

(a) a secondary bevel gear restraining pin cavity on back surface of said rotatable housing that is located above the pawl indexing shaft cavity and in vertical alignment with the pawl pivot and secondary bevel gear restraining pin, (b) a secondary gear restraining pin inserted into the secondary bevel gear restraining pin cavity, (c) a pawl indexing and connecting shaft inserted into the pawl indexing shaft cavity with the keyed shaft lever cavity of said shaft extending outwardly, and (d) a first and second secondary gear restraining cavity located on back surface of said secondary bevel gear where said cavities are in vertical alignment respectively with the secondary bevel gear restraining pin and the pawl pivot and secondary bevel gear restraining pin where said secondary bevel gear is held in place when said gear is inserted into the shaft and aligned with the respective restraining pins.

7. The wrench as specified in claim 2 wherein the means to rotatably restrain said rotatable housing subassembly within the longitudinal housing bore of said front housing is accomplished by having:

(a) a housing retaining clip channel located around the front outside diameter of said rotatable housing, and (b) a housing retaining clip that is snapped into the clip channel after said rotatable housing is inserted into and positioned within said front housing.

8. The wrench as specified in claim 2 wherein the means to pivotally hold said pawl within the pawl mounting channel on said rotatable housing is accomplished by having:

(a) a pawl pivot bore centrally located through side of said pawl, (b) a pawl pivot pin cavity on front wall of the channel and an aligned pawl pivot pin bore on back surface of said rotatable housing, and, (c) a pawl pivot and secondary bevel gear restraining pin that when said pin is inserted, in turn, through the pawl pivot pin bore, pawl pivot bore and into the pawl pivot pin cavity said pawl is pivotally held in place;

(d) a first and second secondary gear restraining cavity located on back surface of said secondary bevel gear where said cavities are in vertical alignment respectively with the secondary bevel gear restraining pin and the pawl pivot and secondary bevel gear restraining pin where said secondary bevel gear is held in place when said gear is inserted into the shaft and aligned with the respective restraining pins.

9. The wrench as specified in claim 2 wherein the means to radially maintain and hold said pawl indexing and connecting shaft when rotated to either of its selected pawl indexing positions is accomplished by having:

(a) a pawl detent bore drilled through the front section of said pawl, indexing and connecting shaft where the hole is centrally aligned with respect to the width of said pawl and with said shaft further having an ON detent flat and an OFF detent flat angularly displaced on each lower side of the detent bore, and, (b) a pawl detent hold subassembly further comprising, in order of insertion into top of the bore on said shaft, a detent pin, a detent compression spring, and a detent ball where the detent pin makes contact with the pawl detent surface on said pawl and the detent ball makes contact with a concave detent located on the upper wall of the pawl indexing shaft cavity on said rotatable housing.

10. The wrench as specified in claim 2 wherein the means to retain said housing cover within the housing cover cavity is accomplished by inserting a housing cover retaining clip into a housing cover retainer channel located on the back inside diameter of said front housing.

11. The wrench as specified in claim 2 further comprising a pawl indexing reference mark located on the top surface of said housing cover.

12. The wrench as specified in claim 2 wherein the diameter of said spin knob is less than the diameter of said handle.

13. The wrench as specified in claim 2 wherein said spinner drive shaft has a threaded section at its back end onto which is attached a compatible threaded spin knob.

14. The wrench as specified in claim 2 wherein said spinner drive shaft has a larger diameter section abutting said spin knob.

15. The wrench as specified in claim 2 wherein said spinner drive shaft and said spin knob are combined to produce a clutch assembly such that when said spin knob is manually rotated to tighten a nut or bolt said knob will slip to indicate to user that nut or bolt is finger tight.

16. The wrench having the clutch assembly as specified in claim 15 further comprising:

(a) a forward clutch plate that is an integral part of the back section of said spinner drive shaft, with back side of said forward clutch plate having a concave detent near the clutch plate perimeter, (b) a clutch shaft integrally extending from the back side of said forward clutch plate with end of said shaft having a retaining bolt threaded bore, (c) a combination back clutch plate/spin knob having on its front side a convex detent located and sized to fit into the concave detent on the forward clutch plate and also having a clutch shaft bore therethrough and a clutch spring cavity extending from its back side, (d) a clutch spring inserted over the clutch shaft within the clutch spring cavity, and (e) a shaft/clutch retaining bolt that is sized to compressively hold the clutch spring when said bolt is threaded into the threaded bore on said clutch shaft.

* * * * *